US005642669A

United States Patent [19]

Becker

[11] Patent Number: 5,642,669

[45] Date of Patent: Jul. 1, 1997

[54] DEVICE FOR TENSIONING A PRINTING PLATE ON PLATE CYLINDERS OF ROTARY PRINTING PRESSES

[75] Inventor: Willi Becker, Bammental, Germany

[73] Assignee: Heidelberger Druckmaschinen Aktiengesellschaft, Heidelberg, Germany

[21] Appl. No.: 639,188

[22] Filed: Apr. 26, 1996

[30] Foreign Application Priority Data

Apr. 29, 1995 [DE] Germany ..... 195 15 843.1

[51] Int. Cl.[6] ..... B41F 1/28

[52] U.S. Cl. ..... 101/415.1

[58] Field of Search ..... 101/415.1, 389.1; 428/909

[56] References Cited

U.S. PATENT DOCUMENTS

| | | | |
|---|---|---|---|
| 5,014,619 | 5/1991 | Jwschke | 101/415.1 |
| 5,080,014 | 1/1992 | Hofheinz | 101/415.1 |
| 5,088,409 | 2/1992 | Roskosch | 101/415.1 |
| 5,367,954 | 11/1994 | Becker | 101/415.1 |
| 5,488,904 | 2/1996 | Kleinschmidt et al. | 101/415.1 |

FOREIGN PATENT DOCUMENTS

| | | | |
|---|---|---|---|
| 3606351 | 2/1986 | Germany | 101/415.1 |
| 4244279 | 6/1994 | Germany . | |

*Primary Examiner*—Edgar S. Burr
*Assistant Examiner*—Dave Ghatt
*Attorney, Agent, or Firm*—Nils H. Ljungman and Associates

[57] ABSTRACT

A device for tensioning a printing plate on plate cylinders of rotary printing presses, the device including a tensioning arrangement disposed in a gap of the plate cylinder for accommodating the plate rear end. The tensioning arrangement also includes a shaft with tensioning elements mounted thereon, and clamping elements for clamping angular and non-angular plate ends, with spring-loaded upper grippers being fastened on the clamping elements for the clamping of non-angular plate ends of printing plates and printing foils.

20 Claims, 4 Drawing Sheets

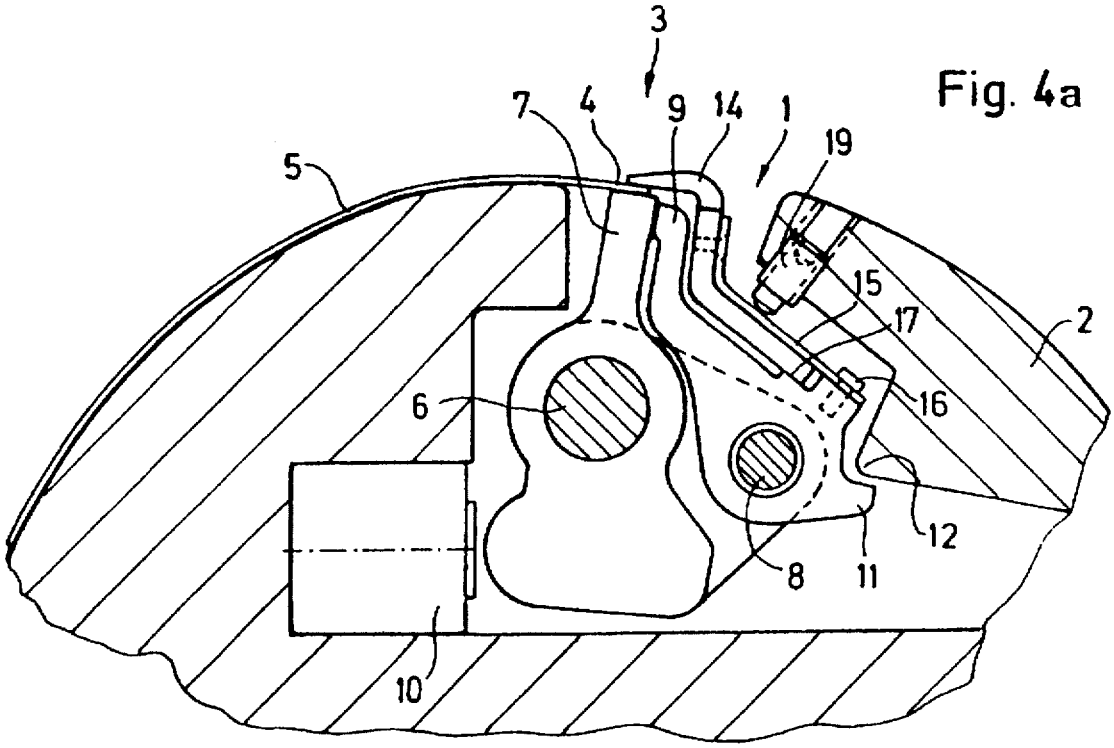
Fig. 4a
Fig. 5
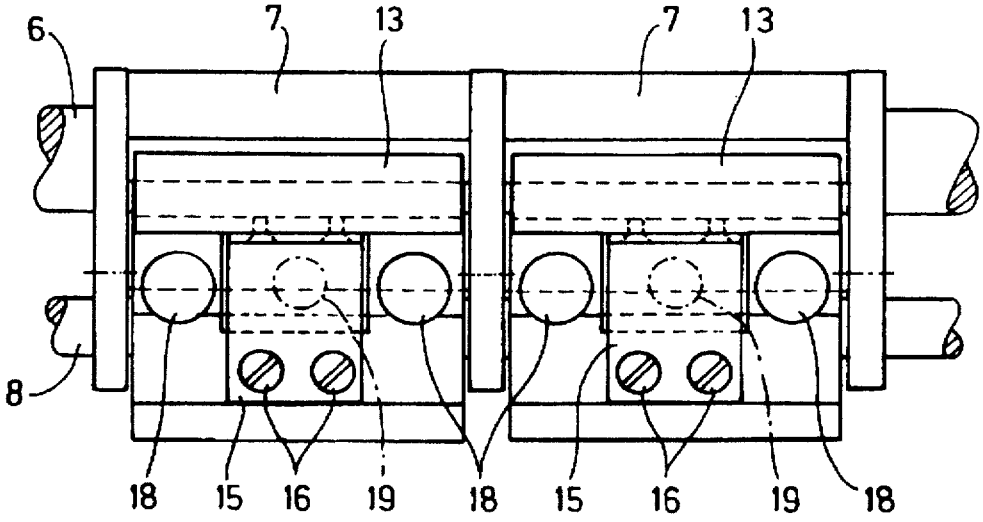

DEVICE FOR TENSIONING A PRINTING PLATE ON PLATE CYLINDERS OF ROTARY PRINTING PRESSES

BACKGROUND OF THE INVENTION

1. Field of the Invention

The invention generally relates to a printing press having a device for tensioning a printing plate on a plate cylinder. More specifically, the present invention relates to a device for tensioning a printing plate on a plate cylinder of a rotary printing press. In essence, a device for tensioning a printing plate on a plate cylinder of rotary printing presses can have a tensioning arrangement disposed in a gap of the plate cylinder for accommodating the printing plate rear end, the tensioning arrangement including a shaft with tensioning elements mounted thereon, and including clamping elements for clamping angular and non-angular printing plate ends. The clamping elements can be held on bolts mounted on the tensioning elements. Further, the tensioning arrangement can also include pressure springs which act on the tensioning and clamping elements, and pneumatic units for relaxing and releasing the printing plate end, whereby the clamping elements, with a shoulder formed thereon, are braced against a projection of the plate cylinder.

2. Background Information

German Patent Application DE 42 44 279 A1, which corresponds to U.S. Pat. No. 5,367,954, shows such a device, whereby several rows of pressure springs are required, in order to clamp and tension the printing plate. With this known construction, however, it is not disclosed as to how the clamping force can be increased.

OBJECT OF THE INVENTION

It is the object of the present invention to simplify the tensioning arrangement for the printing plate end when clamping angular and non-angular ends of printing plates and print foils, and to optimize the tensioning of the printing plate ends.

SUMMARY OF THE INVENTION

In accordance with the present invention, this object is solved in that on the clamping elements there are fastened spring-loaded upper grippers for clamping non-angular printing plates or printing foils, and the pressure springs are arranged between plate cylinder and clamping elements, with their tensional force being directed towards the region between the shaft carrying tensioning elements and the bolts carrying the clamping elements. To this solution only a row of pressure springs needs to be added, in order to carry out the clamping as well as the tensioning of the different printing plate ends. With the spring-loaded upper gripper it is provided that also non-angular printing plate ends, regardless of their thickness, can be clamped with a strong holding force, so that precise tensioning of the printing plate or printing foil is achievable.

In other words, this object is solved by having spring-loaded upper grippers for clamping non-angular printing plates or foils, the upper grippers fastened onto the clamping elements, and by the arrangement of the pressure springs between the plate cylinder and clamping elements, whereby the applied force of the pressure springs is directed towards the region between the shaft carrying the tensioning elements and the bolts carrying the clamping elements. This solution requires only one row of pressure springs to clamp and tension the different printing plate ends. The spring-loaded upper gripper can clamp non-angular printing plate ends with a strong holding force, so that precise tensioning of the printing plate or printing foil is achievable.

An advantageous embodiment of the invention is characterized in that the spring-loaded upper grippers have a rigid gripper part and a spring part. This solution allows an adjustment of the clamping force of the upper gripper to suit particular needs.

A further advantageous embodiment of the invention is characterized in that between the pressure springs disposed in the plate cylinder there are arranged tightening screws which are engageable with the upper grippers for increasing the clamping and tensional force of the tensioning arrangement. With these tightening screws the clamping force, as well as the tensional force acting on the printing plate end, can be increased to an extent, so that, for example, an axial stretching of the plate rear end can take place, regardless of whether an angled or a non-angled plate is used. It is understood that the tightening screws must be screwed backward, when a relaxation or releasing of the plate end is to be carried out.

One aspect of this invention resides broadly in a device for clamping a printing plate on a plate cylinder in a rotary printing press, the plate cylinder having a recess therein for accommodating the device, the clamping device comprising: clamping apparatus for clamping a printing plate to a plate cylinder, the clamping apparatus comprising first clamping apparatus for clamping an angled end of a printing plate, and second clamping apparatus for clamping a non-angled end of a printing plate; the first clamping apparatus and second clamping apparatus at least partially disposed in the recess; the first clamping apparatus comprising a first resiliance, and the second clamping apparatus comprising a second resiliance; the second resiliance being substantially greater than the first resiliance.

Another aspect of this invention resides broadly in a device for clamping a printing plate on a plate cylinder in a rotary printing press, the plate cylinder having a recess therein for accommodating the device, the clamping device comprising: clamping apparatus for clamping a printing plate to a plate cylinder, the clamping apparatus comprising first clamping apparatus for clamping an angled end of a printing plate, and second clamping apparatus for clamping a non-angled end of a printing plate; the first clamping apparatus and second clamping apparatus at least partially disposed in the recess; the first clamping apparatus comprising a first resiliance, and the second clamping apparatus comprising a second resiliance; the second resiliance being substantially greater than the first resiliance; the second resiliance providing a springiness for clamping and holding the non-angled end of a printing plate; the clamping apparatus comprising a third clamping apparatus, the third clamping apparatus further comprising a clamping element mounted on a first shaft, the first shaft being disposed within the recess; the clamping apparatus further comprising an apparatus for pivotally mounting the first clamping apparatus and second clamping apparatus to the clamping element; the clamping apparatus further comprising a biasing apparatus, the biasing apparatus located to apply a force to the first clamping apparatus, the second clamping apparatus, and the third clamping apparatus, the biasing apparatus located to direct the force between the first shaft and second shaft; the biasing apparatus comprising a compression spring located between the plate cylinder and the first clamping apparatus, to clamp and tension a printing plate disposed on the plate cylinder.

An additional aspect of this invention resides broadly in the device comprising a clamping apparatus having a first clamping apparatus and a second clamping apparatus, the first clamping apparatus comprising a first component part and the second clamping apparatus a second component part. A further aspect of said device would broadly reside in the second component part comprising two component parts, a rigid portion and a springy portion.

Yet another aspect of this invention resides broadly in the the device comprising a biasing apparatus to apply force to a clamping apparatus, the clamping apparatus comprising a first clamping apparatus and a second clamping apparatus, the biasing apparatus comprising a tightening screw and a compression spring, the tightening screw located within the plate cylinder adjacent the compression spring, the tightening screw engageable with the second clamping apparatus to further increase the clamping and tensioning force applied to a printing plate disposed on the plate cylinder.

A yet further aspect of this invention resides broadly in the device comprising a biasing apparatus to apply force to a clamping apparatus, the clamping apparatus comprising a first clamping apparatus, a second clamping apparatus, and a third clamping apparatus, the biasing apparatus comprising a compression spring, and a release apparatus used for releasing a printing plate disposed on the plate cylinder, the release apparatus being located to act against the clamping force of the clamping apparatus whereby the first clamping apparatus comprises a shoulder located to engage with a projection on the plate cylinder, to release a upon activation of the release apparatus. A further aspect of said device resides broadly in the release apparatus comprising a pneumatic unit.

BRIEF DESCRIPTION OF THE DRAWINGS

Further characteristic features and advantages of the invention will be apparent from the following description of an exemplary embodiment in view of the accompanying drawings, wherein

FIG. 4*a* is a partial cross-section of the device of FIG. 1, with an engaged tightening screw when using a two-part upper gripper;

FIG. 5 is a partial longitudinal view of the device of FIG. 1;

DESCRIPTION OF THE PREFERRED EMBODIMENT

Figure 1:
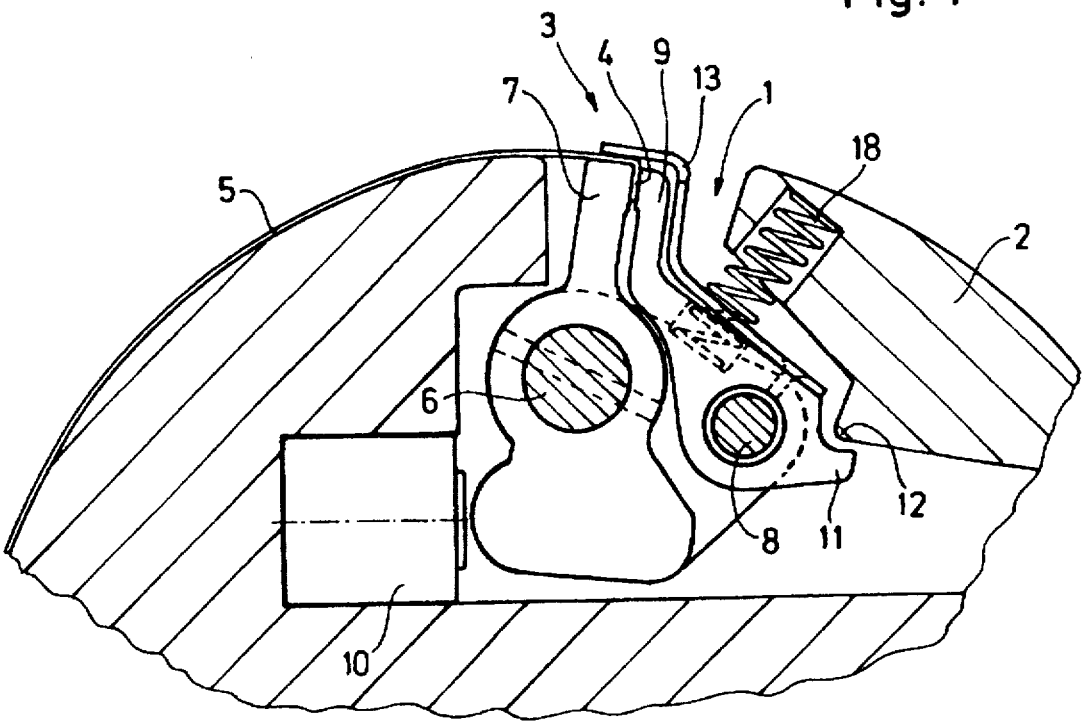
FIG. 1 is a partial cross-section of the device according to the invention, with an angled printing plate being in a locked position.

As illustrated in FIG. 1, in a gap 1 of a plate cylinder 2 there is provided a tensioning arrangement 3 for a plate rear end 4, said tensioning arrangement being constructed for the tensioning of a printing plate 5 on the outer surface of the plate cylinder 2. Tensioning elements 7 are fixedly mounted on a shaft 6 disposed longitudinally in the gap 1 of the plate cylinder 2. Clamping elements 9 are mounted on the tensioning elements 7 via bolts 8, and the angled plate end 4 can be clamped tight by means of the clamping elements 9 together with the tensioning elements 7. Thus, after clamping, the tensioning of the printing plate 5 takes place.

Figure 2:
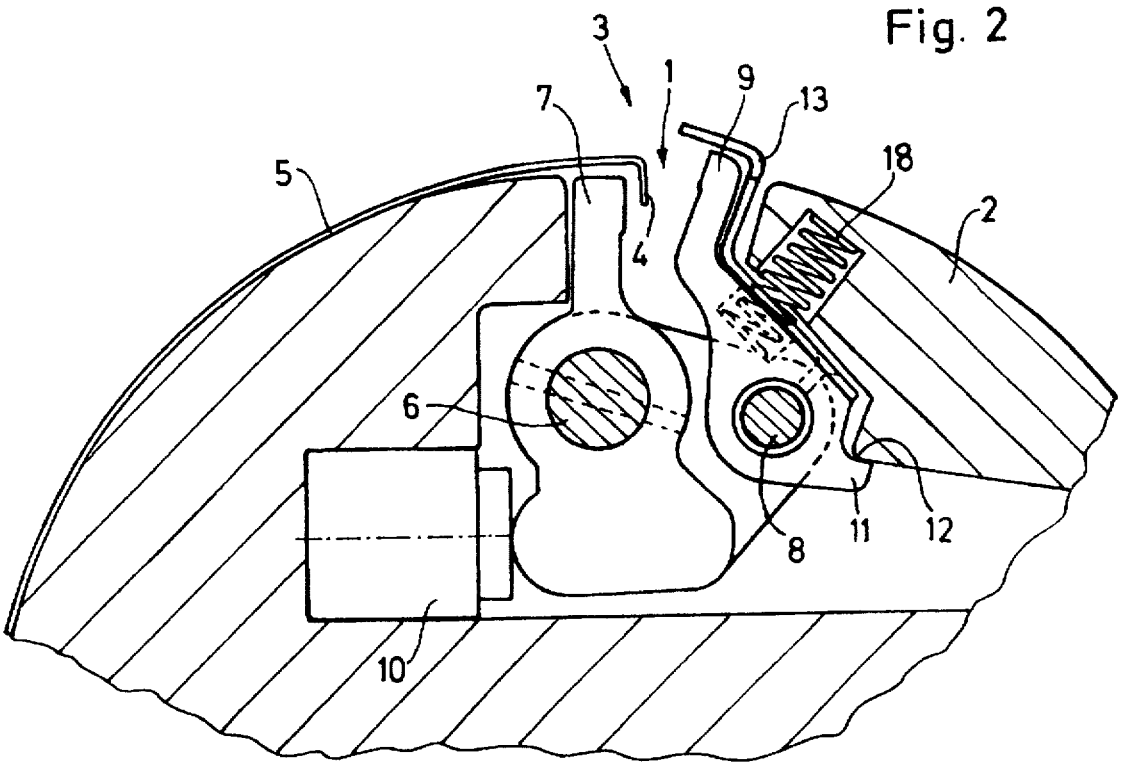
FIG. 2 is a partial cross-section of the device of FIG. 1, with the tensioning arrangement being in an open position.

As shown in FIG. 2, for the relaxing and releasing of the plate end 4, pneumatic units 10 are provided which act on the tensioning element 7, so that the tensioning element 7 is turned in a counter-clockwise direction, whereby a shoulder 11 of the clamping element 9 is braced against a projection 12 of the plate cylinder 2. This causes the clamping element 9 to open itself to an extent, so that the printing plate 5 can be removed and a new printing plate be inserted in simple manner.

In accordance with the invention, spring-loaded upper grippers 13 are fastened to the clamping elements 9, said upper grippers 13 supporting the clamping of the angled plate end 4 and fixedly clamping a non-angular plate end on the tensioning element 7.

Figure 3:
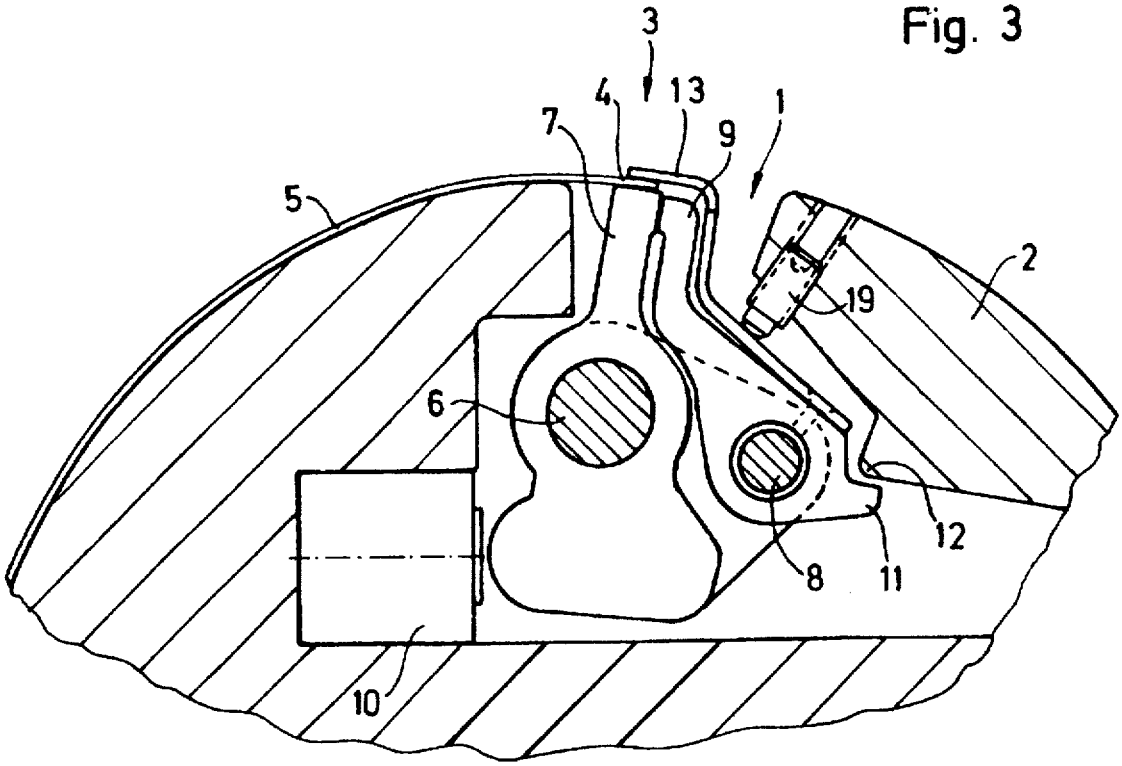
FIG. 3 is a partial cross-section of the device of FIG. 1, showing engaged tightening screws.

In accordance with FIGS. 1 to 3, the upper grippers 13 are made, for example, of spring steel and, with their end located opposite the gripping region, are fastened to the clamping elements 9.

Figure 4:
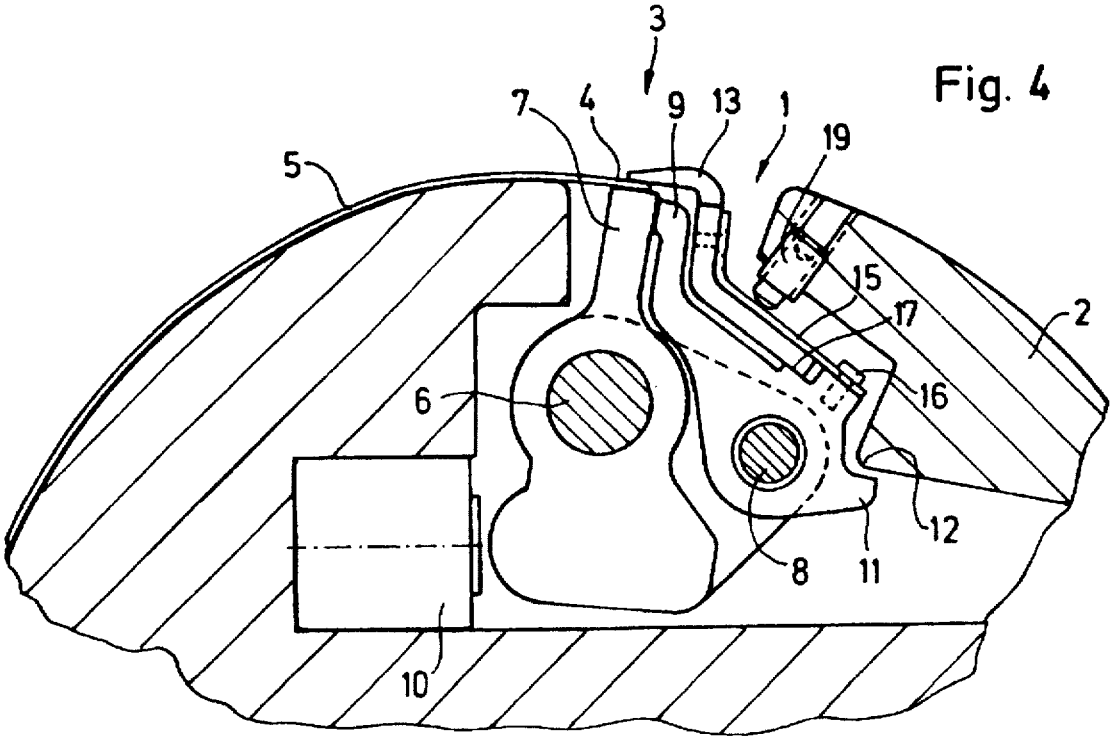
FIG. 4 is a partial cross-section of the device of FIG. 1, with an engaged tightening screw when using a two-part upper gripper.

As shown in FIG. 4 and FIG. 4*a*, the upper grippers 13 can be designed as two parts, the one being a rigid gripper part 14 and the other being a spring part 15. In this design, the spring part 15 is also fastened to the clamping element 9 by means of a screw 16. Additionally, the rigid gripper part 14 is braced against a support surface 17 of the clamping element 9, so that strong clamping forces can be transferred onto the non-angular printing plate end 4 through the rigid gripper part 14.

As shown in FIGS. 1, 2, and 5, the pressure springs 18 (preferably compression springs) can be located between the plate cylinder 2 and the clamping elements 9, and can be arranged along the length of the plate cylinder 2, with the applied force of these pressure springs 18 being directed to the region between the shaft 6 carrying the tensioning elements 7 and the bolt 8 carrying the clamping elements 9. Thus, the applied force of the pressure springs 18 causes a closing of the clamping elements 9 and subsequently a tensioning of the tensioning element 7. Thereby, the clamping element 9 is turned counter-clockwise and the tensioning element 7 is turned clockwise. It is shown hereby that a multiplicity of pressure springs 18 are sufficient, in order to carry out both functions.

The upper grippers 13 act as springs, with clamping force generated by deformation of the upper grippers 13. As shown in FIGS. 1 and 2, counter-clockwise rotation of the clamping element 9 causes the gripping region of the upper grippers 13 to make initial contact with the non-angled portion of the printing plate 5. Further counter-clockwise rotation of the clamping element 9 to its closed position causes deformation of the upper grippers 13 because further rotation of the gripping region is resisted by contact with the non-angled portion of the printing plate 5. Because the other end of the upper grippers 13 is fixed, a reaction force is applied by the gripping portion of the upper grippers 13 to the printing plate 5 thereby clamping the printing plate 5 in place. The spring loading and clamping force of the upper grippers 13 can be modified to suit particular needs.

Between the individual pressure springs 18—as viewed in longitudinal direction of the plate cylinder 2—there are provided tightening screws 19 which, in accordance with FIGS. 3, 4, and 4*a*, are engageable with the one-part, spring-loaded upper gripper 13 (FIG. 3) as well as with the two-part upper gripper 13 (FIGS. 4 and 4a). This engaging action of the screws 19 takes place for the purpose of increasing the tensional force of the tensioning arrangement 3, so that when the printing plate 5 is clamped, a stretching of the printing plate 5 in the circumferential direction can be carried out, regardless of it being an angular or non-angular printing plate. Of course, with such increased tensional force a tensioning of the printing plate end 4 in the axial direction can also be carried out. After such stretching or tensioning of the printing plate 5, the tightening screws 19 are screwed backward again, so that the tensioning arrangement 3 can be operated in normal manner.

As described above and in accordance with one embodiment, the invention can be used to clamp the end 4 of a printing plate 5 to the plate cylinder 2, the printing plate end 4 with or without an angled end portion. As shown in FIGS. 1 and 3, the invention will clamp the printing plate 5 to the plate cylinder 2, regardless of whether the plate end 4 of the printing plate 5 includes an angled end. FIG. 1 illustrates clamping a printing plate 5 to the plate cylinder 2, the printing plate end 4 including an angled end. The clamping elements 9 clamp the angled portion of the plate end 4 between themselves and the tensioning elements 7. The grippers 13 additionally clamp the non-angled portion of the printing plate end 4 between themselves and the tensioning elements 7. FIG. 3 illustrates clamping a printing plate 5 to the plate cylinder 2, the printing plate end 4 having no angled end portion. The clamping elements 9 bear against the tensioning elements 7 without clamping the printing plate 5. However, the grippers 13 will clamp the non-angled portion of the printing plate end 4 between themselves and the tensioning elements 7.

Figure 6:
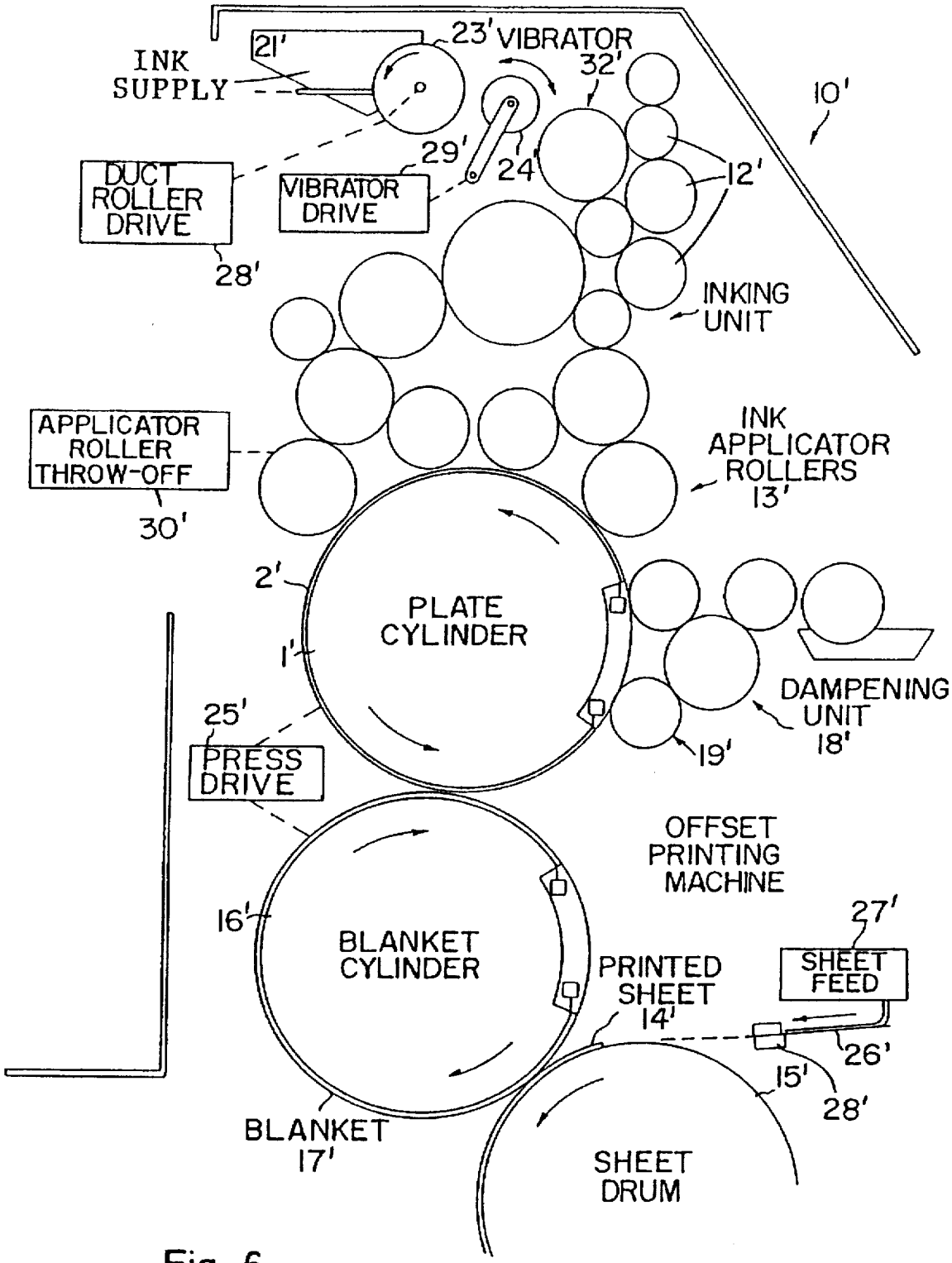
FIG. 6 is a diagrammatic side elevation view of a printing unit of a printing press in which the tensioning device of FIGS. 1–5 could be incorporated.

FIG. 6 illustrates a rotary print stand 10' of a rotary printing press. It should be generally understood that the components as briefly outlined herebelow with respect to the rotary print stand 10' are well-known, and therefore not discussed in any significant detail herein. The rotary print stand 10' can employ a printing plate tensioning device in accordance with the proposed invention. A rotary print stand 10' can generally include: a plate cylinder 1' for having mounted thereon a printing plate 2'; an inking unit 12' which includes ink applicator rollers 13' for applying ink to the printing plate 2'; a dampening (or wetting) unit 18' having dampening applicator rollers 19' for transferring a dampening agent to the printing plate 2', a blanket cylinder 16' carrying a rubber blanket 17' for receiving an ink impression from the printing plate 2', and a sheet drum 15' for carrying a printed sheet 14' onto which the ink impression carried by blanket 17' is transferred. A duct roller 23' is typically mounted adjacent to an ink duct 21'. Typically, ink is transferred from duct roller 23' to inking unit 12' by means of a vibratory roller 24', which vibratory roller oscillates to successively pick up ink from duct roller 23' and deposit the same on a roller 32' of inking unit 12'.

Typically, the printing stand 10' will also include auxiliary mechanisms such as, for example, a duct roller drive 28', a vibrator roller drive 29', an applicator roller throw-off 30' for lifting the ink applicator rollers 13' off of the printing plate 2', a press drive 25' and a sheet feed 27' for supplying the sheets to be printed 26' to sheet drum 15'.

It should be understood that the components discussed above with relation to FIG. 6 may, if appropriate, essentially be considered to be interchangeable with similar components discussed above with relation to FIGS. 1–5. Note plate cylinder 1' in FIG. 6 can correspond to plate cylinder 2 in FIGS. 1–5, and printing plate 2' in FIG. 6 can correspond to printing plate 5 in FIGS. 1–5.

One feature of the invention resides broadly in the device for tensioning a printing plate on a plate cylinder of rotary printing presses, said device comprising a tensioning arrangement disposed in a gap of the plate cylinder for accommodating the plate rear end, said tensioning arrangement including a shaft with tensioning elements mounted thereon, and including clamping elements for clamping angular and non-angular plate ends, said clamping elements being held on bolts mounted on said tensioning elements, and further including pressure springs which act on the tensioning and clamping elements, and pneumatic units for relaxing and releasing the plate end, whereby the clamping elements, with a shoulder formed thereon, are braced against a projection of the plate cylinder, characterized in that on the clamping elements 9 there are fastened spring-loaded upper grippers 13 for clamping non-angular printing plates 5 or printing foils, and that the pressure springs 18 are arranged between the plate cylinder 2 and the clamping elements 9, with the applied force of the pressure springs 18 being directed to the region between the shaft 6 carrying the tensioning elements 7 and the bolts 8 carrying the clamping elements 9.

Another feature of the invention resides broadly in the device wherein the spring-loaded upper gripper 13 comprises a rigid gripper part 14 and a spring part 15.

Yet another feature of the invention resides broadly in the device wherein between the pressure springs 18 on the plate cylinder 2 there are arranged tightening screws 19 which are engageable with the upper grippers 13 for increasing the clamping and tensional force of the tensioning arrangement 3.

A further feature of the invention resides broadly in the device wherein the tensioning elements 7 and the clamping elements 9 with attached upper grippers 13 can be used with either angular or non-angular ends of printing plates or print foils.

Some examples of clamping arrangements and register adjustment apparatus which could possibly be adapted for use in the present invention, along with additional components generally associated with clamping mechanisms and register adjustment apparatus which might be interchangeable with, or adaptable as, components of the embodiments as described hereinabove, might be disclosed by the following U.S. Patents, all of which are assigned to Heidelberger Druckmaschinen Aktiengesellschaft, the assignee for the present invention: U.S. Pat. No. 4,785,736 to Jeschke, entitled "Device for Tensioning a Flexible Printing Plate Mounted on a Plate Cylinder"; U.S. Pat. No. 4,831,931 to Jeschke and Stadtler, entitled "Device for Tensioning a Flexible Printing Plate on a Plate Cylinder of a Rotary Printing Machine"; U.S. Pat. No. 5,014,619 to Jeschke, entitled "Device for Tensioning a Flexible Printing Plate on a Plate Cylinder of a Rotary Printing Machine"; U.S. Pat. No. 5,008,409 to Roskosch, entitled "Device for Adjusting a Flexible Printing Plate on a Plate Cylinder of A Rotary Printing Press"; U.S. Pat. No. 5,367,954 to Becker, entitled "Printing-Form Correction Device Compensating for the Stretching of Print Carriers"; U.S. Pat. No. 5,415,096 to Koch and Vogt, entitled "Device for Correcting Trapezoidal Register Deviations"; U.S. Pat. No. 5,415,097 to Junghans, entitled "Device for Transmitting Tensioning Forces to Printing-Unit Cylinders"; U.S. Pat. No. 5,419,248 to Brotzman, entitled "Adjustable Alignment Device for Printing Plates"; U.S. Pat. No. 5,423,258 to Weber, entitled "Clamping Device for Fastening a Flexible Printing Form on a Jacket Surfaces of a Cylinder"; U.S. Pat. No. 5,440,984 to Becker, entitled "Device for Clamping Flexible Printing Plates on the Plate Cylinder of Rotary Printing Presses"; and U.S. Pat. No. 5,488,904 to Kleinschmidt, et al., entitled "Device for Pivotably Adjusting Flexible Printing Plates on the Plate Cylinder of a Rotary Printing Machine".

Some additional examples of accessories which could possibly be used in the context of the present invention might be disclosed by the following U.S. Patents: U.S. Pat. No. 5,398,609 to Stiel, entitled "Device for Tensioning and Adjusting Flexible Printing Plates on Plate Cylinders of Printing Presses"; U.S. Pat. No. 5,396,843 to Durr entitled "Method and Apparatus for Mounting Flexible Printing Plates on a Forms Cylinder"; U.S. Pat. No. 5,347,928 to Ito, entitled "Plate Clamping Unit for Offset Press"; U.S. Pat. No. 5,337,486 to Brechtel, entitled "Mechanism for Adjusting the Skew Angle of Inclination of a Printing Plate on its Plate Cylinder"; U.S. Pat. No. 5,097,763 to Simeth, entitled "Plate Cylinder Arrangement for a Printing Press".

Further additional examples of accessories which could possibly be used in the context of the present invention might be disclosed by the following Federal Republic of Germany Patents: 1 536 954 to Janeczek et al., DE 39 36 446 C2 issued to Simeth, and DE 41 34 365 A1 issued on Jehring, et al.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 15 843.1, filed on Apr. 29, 1995, having inventor Willi Becker, and DE-OS 195 15 843.1 and DE-PS 195 15 843.1, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1: cylinder gap
2: plate cylinder
3: tensioning arrangement
4: plate rear end
5: printing plate
6: shaft
7: tensioning elements
8: bolts
9: clamping elements
10: pneumatic units
11: shoulder of clamping element 9
12: projection of plate cylinder 2
13: upper grippers
14: gripper part of gripper
15: spring part of gripper
16: screw
17: support surface of clamping element 9
18: pressure springs
19: tightening screw
1': plate cylinder
2': printing plate
10': rotary print stand
13': ink application rollers
14': printed sheet
15': sheet drum
16': blanket cylinder
17': rubber blanket
18': dampening unit
19': dampening application rollers
21': ink duct
23': duct roller
24': vibratory roller
25': press drive
26': sheet to be printed
27': sheet feed
28': duct roller drive
29': vibration roller drive
30': application roller throw-off
32': roller

What is claimed is:

1. A device for clamping a printing plate on a plate cylinder in a rotary printing press, the plate cylinder having a recess therein for accommodating the device, said device comprising:

clamping means for clamping a printing plate to a plate cylinder, said clamping means comprising first clamping means, second clamping means and third clamping means;

said first clamping means for clamping an angled end of a printing plate to a plate cylinder;

said first clamping means being at least partially disposed within the recess;

said first clamping means comprising a first resiliance;

said second clamping means for clamping a non-angled end of a printing plate to the plate cylinder;

said second clamping means being at least partially disposed within the recess;

said second clamping means comprising a second resiliance;

said second resiliance being substantially greater than said first resiliance;

said second resiliance providing a resiliance sufficient for clamping and holding a non-angled end of a printing plate to the plate cylinder;

biasing means;

said biasing means being disposed between the plate cylinder and at least one of: said first clamping means and said second clamping means;

said biasing means for applying a force to at least one of: said first clamping means and said second clamping means;

said third clamping means comprising at least one clamping element;

said third clamping means comprising a first shaft;

said first shaft being disposed within the recess;

said at least one clamping element being disposed on said first shaft;

said clamping means further comprising means for pivotally mounting said first clamping means and second clamping means to said at least one clamping element;

said pivotal mounting means comprising a second shaft;

said second shaft being disposed offset from said first shaft;

said biasing means being disposed to apply a force to said first clamping means, said second clamping means, and said third clamping means to clamp and tension a printing plate disposed on the plate cylinder;

said biasing means disposed to apply a force to said clamping means between said first shaft and said second shaft;

said biasing means comprising at least one compression spring; and said compression spring being disposed between the plate cylinder and said first clamping means.

2. The device according to claim 1, wherein:

said first clamping means comprises a first component part;

said second clamping means comprising a second component part;

said first component part being separate from said second component part; and said second component part comprising a rigid component portion and a resilient component portion.

3. The device according to claim 1, wherein:

said biasing means comprises at least one tightening screw;

said at least one tightening screw being disposed within the plate cylinder;

said at least one tightening screw being engageable with said second clamping means for increasing the clamping and tensioning force applied to a printing plate disposed on a plate cylinder;

said device further comprising force-applying means;

said force-applying means comprising means for releasing a printing plate disposed on said plate cylinder;

said force-applying means being disposed to act against the force of said first clamping means, said second clamping means, and said third clamping means;

said plate cylinder comprising a projection;

said first clamping means comprising a shoulder formed thereon;

said shoulder being disposed to operatively contact said projection upon activation of said force-applying means;

said force-applying means providing the operative contact and force for moving said first clamping means and second clamping means;

said force-applying means comprising at least one pneumatic unit;

said pneumatic unit being disposed in the plate cylinder; and said pneumatic unit being disposed to be engageable with the third clamping means.

4. A device for clamping a printing plate on a plate cylinder of a rotary printing press, which plate cylinder has a recess therein for accommodating the device, said device comprising:

clamping means for clamping a printing plate to a plate cylinder, said clamping means comprising first clamping means and second clamping means;

said first clamping means for clamping an angled end of a printing plate to a plate cylinder;

said first clamping means being at least partially disposed within the recess;

said first clamping means comprising a first resiliance;

said second clamping means for clamping a non-angled end of a printing plate to a plate cylinder;

said second clamping means being at least partially disposed within the recess;

said second clamping means comprising a second resiliance; and said second resiliance being substantially greater than said first resiliance.

5. The device according to claim 4, wherein:

said second resiliance provides a springiness for clamping and holding a non-angled end of a printing plate to a plate cylinder.

6. The device according to claim 5, said device further comprising biasing means, wherein:

said biasing means is disposed between a plate cylinder and at least one of: said first clamping means and said second clamping means; and said biasing means for applying a force to at least one of: said first clamping means and said second clamping means, to clamp a printing plate on a plate cylinder.

7. The device according to claim 6, wherein:

said clamping means comprises a third clamping means;

said third clamping means comprising at least one clamping element;

said third clamping means comprising a first shaft;

said first shaft being disposed within the recess;

said at least one clamping element being disposed on said first shaft;

said clamping means comprising means for pivotally mounting said first clamping means and second clamping means to said at least one clamping element;

said pivotal mounting means comprising a second shaft;

said second shaft being disposed offset from said first shaft; and said biasing means being disposed to apply a force to the first clamping means, the second clamping means, and the third clamping means, to clamp and tension a printing plate on a plate cylinder.

8. The device according to claim 7, wherein:

said biasing means is disposed to apply a force to said clamping means between said first shaft and said second shaft to clamp and tension a printing plate disposed on a plate cylinder.

9. The device according to claim 8, wherein:

said biasing means comprising at least one compression spring;

said at least one compression spring disposed between a plate cylinder and said first clamping means.

10. The device according to claim 9, wherein:

said first clamping means comprises a first component part;

said second clamping means comprising a second component part; and said first component part being separate from said second component part.

11. The device according to claim 10, wherein:

said second component part comprises a rigid component portion and a springy component portion.

12. The device according to claim 10, wherein:

said biasing means comprises at least one tightening screw;

said at least one tightening screw being disposed within a plate cylinder; and said at least one tightening screw being engageable with said second clamping means for increasing the clamping and tensioning force applied to a printing plate disposed on a plate cylinder.

13. The device according to claim 12, said device further comprising force-applying means, wherein:

said force-applying means comprises means for releasing a printing plate disposed on a plate cylinder; and said force-applying means being disposed to act against the force of said first clamping means and said second clamping means.

14. The device according to claim 13, wherein:

said force-applying means is disposed to act against the force of said third clamping means for releasing a printing plate disposed on a plate cylinder.

15. The device according to claim 14, wherein a plate cylinder comprises a projection, and further wherein:

said first clamping means comprises a shoulder formed thereon;

said shoulder being disposed to operatively contact the projection of a plate cylinder upon activation of said force-applying means; and said force-applying means providing the operative contact and force for moving said first clamping means and second clamping means to release a printing plate disposed on a plate cylinder.

16. The device according to claim 15, wherein:

said force-applying means comprises at least one pneumatic unit;

said pneumatic unit being disposed in the plate cylinder; and said pneumatic unit being disposed to be engageable with the third clamping means for the release of a printing plate on a plate cylinder.

17. A printing press comprising:

at least one print stand comprising:

a plate cylinder for having mounted thereon a printing plate;

said plate cylinder having a recess therein;

an inking unit for supplying ink to said plate cylinder;

said inking unit comprising:

an ink duct;

a plurality of inking rollers;

means for transferring ink between said ink duct and said plurality of inking rollers;

a dampening unit for supplying dampening agent to said printing plate;

a blanket cylinder having means for being engaged with said plate cylinder;

means for feeding planar sheets to said at least one print stand;

clamping means for clamping a printing plate to a plate cylinder, said clamping means comprising first clamping means and second clamping means;

said first clamping means for clamping an angled end of a printing plate to the plate cylinder;

said first clamping means being at least partially disposed within said recess;

said first clamping means comprising a first resiliance;

said second clamping means for clamping a non-angled end of a printing plate to the plate cylinder;

said second clamping means being at least partially disposed within said recess;

said second clamping means comprising a second resiliance; and said second resiliance being substantially greater than said first resiliance.

18. The printing press according to claim 17, wherein:

said second resiliance provides a resiliance sufficient for clamping and holding a non-angled end of a printing plate to the plate cylinder;

said clamping means further comprising biasing means;

said biasing means being disposed between said plate cylinder and at least one of: said first clamping means and said second clamping means;

said biasing means for applying a force to at least one of: said first clamping means and said second clamping means;

said clamping means comprising a third clamping means;

said third clamping means comprising at least one clamping element;

said third clamping means comprising a first shaft;

said first shaft being disposed within said recess;

said at least one clamping element being disposed on said first shaft;

said clamping means comprising means for pivotally mounting said first clamping means and second clamping means to said at least one clamping element; said pivotal mounting means comprising a second shaft;

said second shaft being disposed offset from said first shaft;

said biasing means being disposed to apply a force to said first clamping means, said second clamping means, and said third clamping means to clamp and tension a printing plate disposed on said plate cylinder;

said biasing means being disposed to apply a force to said clamping means between said first shaft and second shaft;

said biasing means comprising at least one compression spring;

said at least one compression spring being disposed between the plate cylinder and said first clamping means;

said first clamping means comprising a first component part;

said second clamping means comprising a second component part;

said first component part being separate from said second component part;

said biasing means comprising at least one tightening screw;

said at least one tightening screw being disposed within said plate cylinder; and said at least one tightening screw engageable with said second clamping means for increasing the clamping and tensioning force of a printing plate on said plate cylinder.

19. The printing press according to claim 18, wherein:

said second component part comprises a rigid component portion and a springy component portion.

20. The printing press according to claim 18, said printing press further comprising force-applying means, wherein:

said force-applying means comprises means for releasing a printing plate disposed on said plate cylinder;

said force-applying means being disposed to act against the force of said first clamping means, said second clamping means, and said third clamping means;

said plate cylinder comprising a projection;

said first clamping means comprising a shoulder formed thereon;

said shoulder disposed to operatively contact said projection upon activation of said force-applying means;

said force-applying means providing the operative contact and force for moving said first clamping means and second clamping means;

said force-applying means comprising at least one pneumatic unit;

said pneumatic unit being disposed in the plate cylinder; and said pneumatic unit being disposed to be engageable with the third clamping means.

* * * * *

UNITED STATES PATENT AND TRADEMARK OFFICE

CERTIFICATE OF CORRECTION

PATENT NO. : 5,642,669
DATED : July 1, 1997
INVENTOR(S) : Willi BECKER

It is certified that error appears in the above-identified patent and that said Letters Patent is hereby corrected as shown below:

In column 6, line 54, after 'No.', delete "5,008,409" and insert --5,088,409--.

In column 6, line 66, after 'Jacket', delete "Surfaces" and insert --Surface--.

In column 7, line 12, after the first occurrence of 'a', delete "Forms" and insert --Forme--.

In column 7, line 22, after the second occurrence of 'issued', delete "on" and insert --to--.

Signed and Sealed this

Seventh Day of October, 1997

*Attest:*

*Attesting Officer*

BRUCE LEHMAN

*Commissioner of Patents and Trademarks*